US008646272B2

(12) United States Patent
Baik et al.

(10) Patent No.: US 8,646,272 B2
(45) Date of Patent: Feb. 11, 2014

(54) RANKINE CYCLE SYSTEM AND METHOD OF CONTROLLING THE SAME

(75) Inventors: Young Jin Baik, Daejeon (KR); Huyng Kee Yoon, Daejeon (KR); Ki Chang Chang, Daejeon (KR); Min Sung Kim, Daejeon (KR); Young Soo Lee, Seoul (KR); Ho Sang Ra, Daejeon (KR); Seong Ryong Park, Daejeon (KR); Jun Tack Park, Daejeon (KR)

(73) Assignee: Korea Institute of Energy Research, Daejeon (KR)

( * ) Notice: Subject to any disclaimer, the term of this patent is extended or adjusted under 35 U.S.C. 154(b) by 654 days.

(21) Appl. No.: 12/789,027

(22) Filed: May 27, 2010

(65) Prior Publication Data

US 2011/0079012 A1 Apr. 7, 2011

(30) Foreign Application Priority Data

Oct. 6, 2009 (KR) ..... 10-2009-0094789

(51) Int. Cl.
*F01K 25/00* (2006.01)
*F01K 7/00* (2006.01)
*F01K 13/00* (2006.01)

(52) U.S. Cl.
USPC ..... 60/645; 60/671; 60/675

(58) Field of Classification Search
USPC ..... 60/645–681
See application file for complete search history.

(56) References Cited

U.S. PATENT DOCUMENTS

| | | | | |
|---|---|---|---|---|
| 6,751,959 | B1 * | 6/2004 | McClanahan et al. | 60/670 |
| 6,986,251 | B2 * | 1/2006 | Radcliff et al. | 60/651 |
| 7,997,076 | B2 * | 8/2011 | Ernst | 60/616 |
| 2003/0213246 | A1 * | 11/2003 | Coll et al. | 60/653 |
| 2006/0225421 | A1 * | 10/2006 | Yamanaka et al. | 60/645 |
| 2006/0236698 | A1 * | 10/2006 | Langson | 60/651 |
| 2008/0047272 | A1 * | 2/2008 | Schoell | 60/648 |

* cited by examiner

*Primary Examiner* — Thomas Denion
*Assistant Examiner* — Brian Inacay
(74) *Attorney, Agent, or Firm* — Rabin & Berdo, P.C.

(57) ABSTRACT

There is provided a Rankine cycle system which generates electricity by using heat as an energy source, in which a conventional pump for carrying a working fluid is not used, thereby reducing the cost of manufacturing the Rankine cycle system, saving the electric power consumed to operate the pump and therefore obtaining a greater output of power, and in which a control system is used to automatically operate the Rankine cycle system, thereby enabling to stably operate the Rankine cycle system even though a heat source is intermittently supplied.

8 Claims, 6 Drawing Sheets

RANKINE CYCLE SYSTEM AND METHOD OF CONTROLLING THE SAME

CROSS-REFERENCE TO RELATED PATENT APPLICATION

This application claims the benefit of Korean Patent Application No. 10-2009-0094789, filed on Oct. 6, 2009, in the Korean Intellectual Property Office, the disclosure of which is incorporated herein in its entirety by reference.

BACKGROUND OF THE INVENTION

1. Field of the Invention

The present invention relates to a Rankine cycle system and a method of controlling the same, and more particularly, to a Rankine cycle system which generates electricity by using heat as an energy source, in which a conventional pump for carrying a working fluid is not used, thereby reducing the cost of manufacturing the Rankine cycle system, saving the electric power consumed to operate the pump and therefore obtaining a greater output of power, and in which a control system is used to automatically operate the Rankine cycle system, thereby enabling to stably operate the Rankine cycle system even though a heat source is intermittently supplied, and a method of controlling the same.

2. Description of the Related Art

Generally, as illustrated in FIG. 1, when a working fluid is heated in an evaporator 1 by using heat supplied from a heat source, the working fluid turns into a gas at a high temperature and high pressure, to flow into an expander 2. During the process that the working fluid expands at a low pressure state in the expander 2, the Rankine cycle generates electricity, using a generator 3.

The working fluid discharged from the expander 2 enters a condenser 4 and is condensed by heat-exchange with cooling water. The working fluid condensed in the condenser 4 becomes a liquid at a low temperature and low pressure in a lower part of the condenser 4. After the working fluid in the liquid state becomes a low temperature and high pressure state while passing through a working fluid pump 5, it again flows into the evaporator 1, so that the above-described processes are repeated.

However, in the aforementioned conventional Rankine cycle, since the expensive working fluid pump is needed and a lot of power is consumed to operate the working fluid pump, the output of the cycle is decreased and therefore the efficiency of the cycle is decreased.

SUMMARY OF THE INVENTION

To solve the above problems of the conventional art, it is therefore an object of the present invention to provide a Rankine cycle system which generates electricity by using heat as an energy source, in which a conventional pump for carrying a working fluid is not used, thereby reducing the cost of manufacturing the cycle system, saving the power consumed to operate the pump and therefore obtaining a greater output, and a method of controlling the same.

It is the other object of the present invention to provide a Rankine cycle system in which a control system is used to automatically operate the cycle system, thereby enabling to stably operate the cycle system even though a heat source is intermittently supplied, and a method of controlling the same.

In accordance with an exemplary embodiment of the present invention, there is provided a Rankin cycle system which generates electricity, comprising: an evaporator filled with a working fluid heated by heat supplied from a heat source, for evaporating the working fluid so as to be converted into a high temperature and high pressure gaseous state; an expander connected to the evaporator by a pipe, for expanding the high-temperature and high-pressure working fluid in the gaseous state flowing into the expander; a generator attached to the expander, for generating electricity; and a condenser connected to the expander by a pipe through which the expanded working fluid flows into the condenser, for condensing the working fluid by heat-exchange with cooling water transferred from the outside so that the working fluid is converted into a low temperature and low pressure liquid state, and for transferring the low-temperature and low-pressure working fluid to the evaporator through two pipes connecting the condenser and the evaporator.

In accordance with another exemplary embodiment of the present invention, there is provided a Rankin cycle system which generates electricity, comprising: an evaporator filled with a working fluid heated by heat supplied from a heat source, for evaporating the working fluid so as to be converted into a high temperature and high pressure gaseous state; an expander connected to the evaporator by a pipe, for expanding the high-temperature and high-pressure working fluid flowing into the expander; a generator attached to the expander, for generating electricity; a condenser connected to the expander by a pipe through which the expanded working fluid flows into the condenser, for condensing the working fluid by heat-exchange with cooling water transferred from the outside so that the working fluid is converted into a low temperature and low pressure liquid state, and for transferring the low-temperature and low-pressure working fluid to the evaporator through two pipes connecting the condenser and the evaporator; and a differential pressure transducer for measuring a difference between the pressure at an outlet of the evaporator and the pressure at an outlet of the expander.

In accordance with another exemplary embodiment of the present invention, there is provided a method of controlling a Rankine cycle system, comprising: a step S100 of heating a working fluid by using heat from a heat source and evaporating the working fluid in an evaporator so as to be of a high temperature and high pressure while first, second and third switch valves are closed; a step S110 of opening the first switch valve to permit the high-temperature and high-pressure working fluid to flow into an expander so as to expand when a pressure difference $\Delta P$ between the pressure before the expander and the pressure after the expander reaches a preset pressure difference $\Delta Pa$; a step S120 of generating electricity by using a generator while the working fluid is expanding in the expander; a step S130 of transferring the working fluid expanded in the expander to a condenser and condensing the working fluid at a low-temperature and low-pressure in the condenser by heat-exchange with cooling water provided from the outside; a step S140 of closing the first switch valve and opening the second and third switch valves simultaneously when the working fluid is not present in the evaporator, thereby equalizing the pressure of the evaporator and the pressure of the condenser so that the low-temperature and low-pressure working fluid is transferred to the evaporator by gravity; and a step S150 of closing the second and third switch valves when the working fluid of the condenser is completely transferred to the evaporator, wherein the whole processes are repeatedly performed by the operation of the evaporator.

In accordance with another exemplary embodiment of the present invention, there is provided a method of controlling a Rankine cycle system, comprising: a step S200 of heating a working fluid by using heat from a heat source and evaporating the working fluid in an evaporator so as to be of a high temperature and high pressure while first, second and third solenoid valves are closed; a step S210 of opening the first solenoid valve by a first controller, to permit the high-temperature and high-pressure working fluid to flow into an expander so as to expand when a pressure difference ΔP between the pressure before the expander and the pressure after the expander reaches a pressure difference ΔPa preset in a differential pressure transducer; a step S220 of generating electricity by using a generator while the working fluid is expanding in the expander; a step S230 of transferring the working fluid expanded in the expander to a condenser and condensing the working fluid at a low temperature and low pressure in the condenser by heat-exchange with cooling water provided from the outside; a step S240 of opening the second and third solenoid valves simultaneously by a second controller receiving a signal from a first liquid level switch when the liquid level of the working fluid in the evaporator reaches the first liquid level switch, thereby equalizing the pressure in the evaporator and the pressure in the condenser so that the working fluid in the condenser is transferred to the evaporator by gravity; and a step S250 of closing the second and third solenoid valves by the second controller receiving a signal from a second liquid level switch when the working fluid of the condenser is transferred to the evaporator and the liquid level in the condenser reaches the second liquid level switch, wherein the whole processes are repeatedly performed by the operation of the evaporator.

BRIEF DESCRIPTION OF THE DRAWINGS

The above and other features and advantages of the present invention will become more apparent by describing in detail exemplary embodiments thereof with reference to the attached drawings in which.

BRIEF DESCRIPTION OF REFERENCE NUMBERS OF MAJOR ELEMENTS

Figure 1:
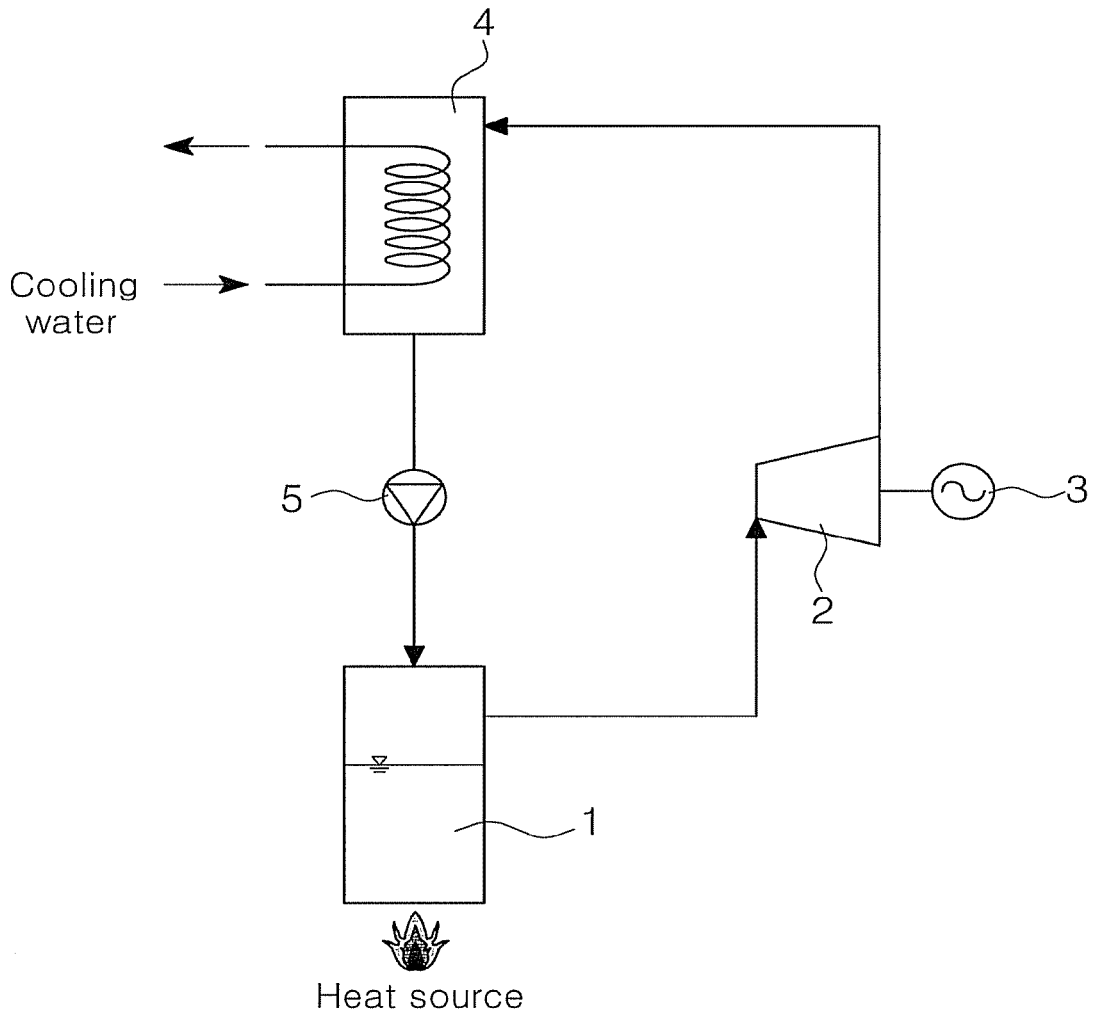
FIG. 1 is a schematic view illustrating a conventional Rankine cycle.

| | |
|---|---|
| 10: evaporator | 20: expander |
| 30: generator | 40: condenser |
| 50: differential pressure transducer | 60: first controller |
| 70: second controller | 80: first switch valve |
| 81: second switch valve | 82: third switch valve |
| 90: first solenoid valve | 91: second solenoid valve |
| 92: third solenoid valve | 93: first liquid level switch |
| 94: second liquid level switch | 100: check valve |

DETAILED DESCRIPTION OF THE INVENTION

The present invention will now be described more fully hereinafter with reference to the accompanying drawings, in which preferred embodiments of the invention are shown.

It will be understood that words or terms used in the specification and claims shall not be interpreted as the meaning defined in commonly used dictionaries. It will be further understood that the words or terms should be interpreted as having a meaning that is consistent with their meaning in the context of the relevant art and the technical idea of the invention, based on the principle that an inventor may properly define the meaning of the words or terms to best explain the invention.

Accordingly, while example embodiments of the present invention are capable of various modifications and alternative forms, embodiments of the present invention are shown by way of example in the drawings and will herein be described in detail. It should be understood, however, that there is no intent to limit example embodiments of the invention to the particular forms disclosed, but on the contrary, example embodiments of the invention are to cover all modifications, equivalents, and alternatives falling within the scope of the invention.

Figure 2:
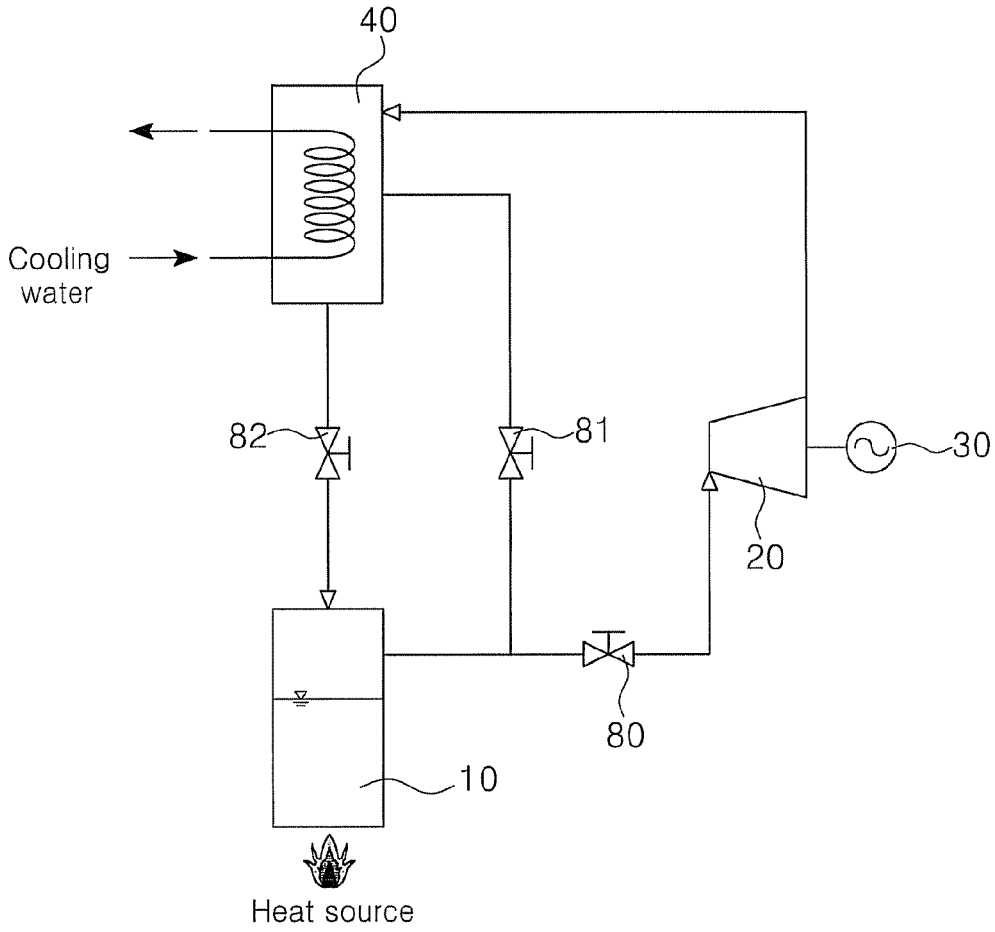
FIG. 2 is a schematic view illustrating a Rankine cycle system according to a first embodiment of the present invention.

FIG. 2 is a schematic view illustrating a Rankine cycle system according to a first embodiment of the present invention. As illustrated in FIG. 2, the Rankine cycle system according to the first embodiment is to generate electricity. The Rankine cycle system comprises: an evaporator 10 being full of a working fluid and evaporating the working fluid heated by heat supplied from a heat source, so that the working fluid is converted into a high temperature and high pressure gas state; an expander 20 connected to the evaporator 10 by a pipe and expanding the high-temperature and high-pressure working fluid flowing into the expander 20 through the pipe; a generator 30 attached to the expander 20 and generating electricity; and a condenser 40 connected to the expander 20 by a pipe through which the expanded working fluid flows into the condenser 40, condensing the working fluid by heat-exchange with cooling water transferred from the outside, so that the working fluid is converted into a low temperature and low pressure liquid state, and transferring the low-temperature and low-pressure working fluid to the evaporator 10 through two pipes connected to the evaporator 20.

The condenser 40 is installed at a higher position than the evaporator 10. Accordingly, when the pressure of the condenser 40 is equal to the pressure of the evaporator 10, the working fluid is transferred to the evaporator 10 by gravity.

A first switch valve 80 is installed at the pipe connecting the evaporator 10 and the expander 20, to permit/interrupt the flow of the working fluid. A second switch valve 81 is installed at one of the two pipes connecting the evaporator 10 and the condenser 40, and a third switch valve 82 is installed at the other pipe, to equalize the pressure between the condenser 40 and the evaporator 10 and to permit/interrupt the flow of the working fluid.

Figure 3:
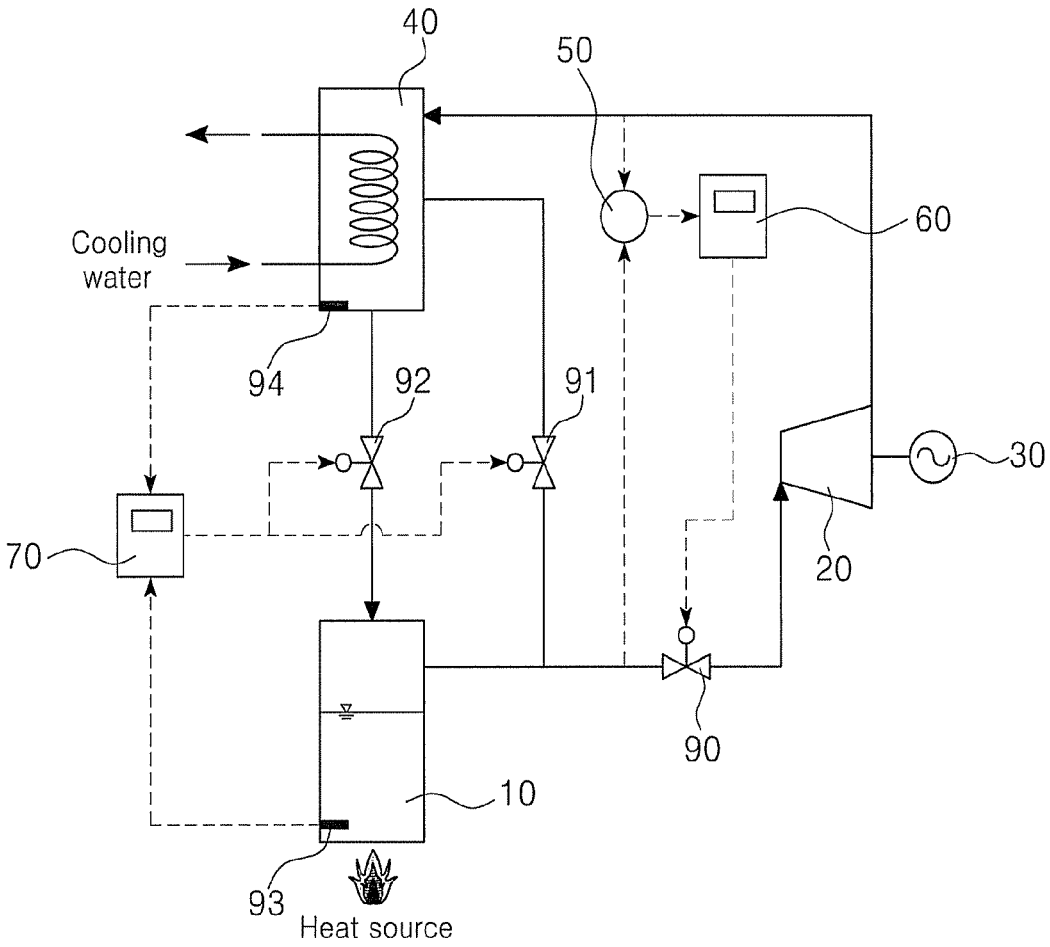
FIG. 3 is a schematic view illustrating a Rankine cycle system according to a second embodiment of the present invention.

FIG. 3 is a schematic view illustrating a Rankine cycle system according to a second embodiment of the present invention. As illustrated in FIG. 3, the Rankine cycle system according to the second embodiment is to generate electricity. The Rankine cycle system comprises: an evaporator 10 being full of a working fluid and evaporating the working fluid heated by heat supplied from a heat source, so that the working fluid is converted into a high temperature and high pressure gas state; an expander 20 connected to the evaporator 10 by a pipe and expanding the high-temperature and high-pressure working fluid flowing into the expander 20 through the pipe; a generator 30 attached to the expander 20 and generating electricity; a condenser 40 connected to the expander 20 by a pipe through which the expanded working fluid flows into the condenser 40, condensing the working fluid by heat-exchange with cooling water transferred from the outside, so that the working fluid is converted into a low temperature and low pressure liquid state, and transferring the low-temperature and low-pressure working fluid to the evaporator 10 through two pipes connected to the evaporator 20; and a differential pressure transducer 50 measuring a difference between the pressure at an outlet of the evaporator 10 and the pressure at an outlet of the expander 20.

The condenser 40 is positioned to be higher than the evaporator 10. Accordingly, when the pressure in the condenser 40 is equal to the pressure in the evaporator 10, the working fluid is transferred to the evaporator 10 by gravity.

A first solenoid valve 90 is installed at the pipe connecting the evaporator 10 and the expander 20, to permit/interrupt the flow of the working fluid. A second solenoid valve 91 is installed at one of the two pipes connecting the evaporator 10 and the condenser 40, and a third solenoid valve 92 is installed at the other pipe, to equalize pressure and to permit/interrupt the flow of the working fluid.

The Rankine cycle system further comprises: a first controller 60 opening/closing the first solenoid valve 90 by receiving a differential pressure signal from the differential pressure transducer 50 and comparing a pressure difference with a preset pressure difference. The first controller 60 reads the signal from the differential pressure transducer 50 converting the difference between the pressure at the outlet of the evaporator 10 and the pressure at the outlet of the expander 20 into the electrical signal. When the pressure difference is above the preset pressure difference (which is considered to smoothly operate the expander 20), the first controller 60 opens the first solenoid valve 90. When the pressure difference is below the preset pressure difference, the first controller 60 closes the first solenoid valve 90.

A first liquid level switch 93 is installed at a bottom inside the evaporator 10 and a second liquid level switch 94 is installed at a bottom inside the condenser 40, both measuring the level of the working fluid. The Rankine cycle system further comprises: a second controller 70 opening/closing the second and third solenoid valves 91 and 92 by receiving the signals measured by the first and second liquid level switches 93 and 94.

When the first liquid level switch 93 is turned off (that is, when the working fluid is not present in the evaporator 10), the second controller 70 opens the second and third solenoid valves 91 and 92 simultaneously until the second liquid level switch 94 is turned off (that is, until the working fluid is not present in the condenser 40). When the second and third solenoid valves 91 and 92 are opened simultaneously and the second liquid level switch 94 is turned off, the second controller 70 closes the second and third solenoid valves 91 and 92 simultaneously.

Further, when the first and second liquid level switches 93 and 94 are turned on simultaneously, except for the aforementioned state, the second controller 70 closes the second and third solenoid valves 91 and 92 simultaneously. After the aforementioned control system is configured, when the condenser 40 and the evaporator 10 are sufficiently filled with the working fluid, the Rankine cycle system is automatically operated.

Figure 4:
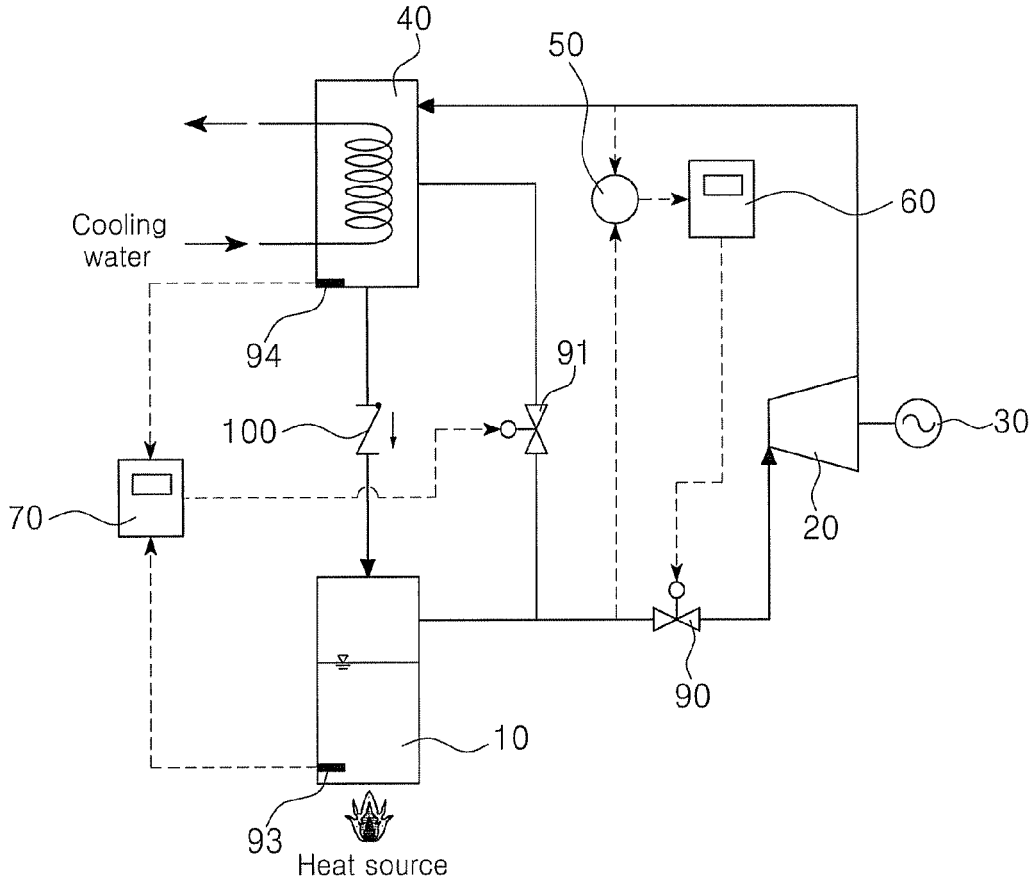
FIG. 4 is a schematic view illustrating a Rankine cycle system according to a third embodiment of the present invention.

FIG. 4 is a schematic view illustrating a Rankine cycle system according to a third embodiment of the present invention. As illustrated in FIG. 4, the Rankine cycle system is same as that according to the second embodiment with respect to the constitution, structure and system. But, the Rankine cycle system according to the third embodiment uses a check valve 100 instead of the third solenoid valve 92 used in the Rankine cycle system according to the second embodiment. The check valve 100 performs the same function as that of the third solenoid valve 92 and permits the working fluid to be only transferred from the condenser 40 to the evaporator 10.

In the Rankine cycle system according to the third embodiment, the use of the check valve 100 reduces the costs involved with the constitution of the control system and the power consumption (based on the electric power depending on the connective relation between the second controller 70 and the third solenoid valve 92 and the operation thereof). Therefore, the efficiency of the Rankine cycle system increases.

Figure 5:
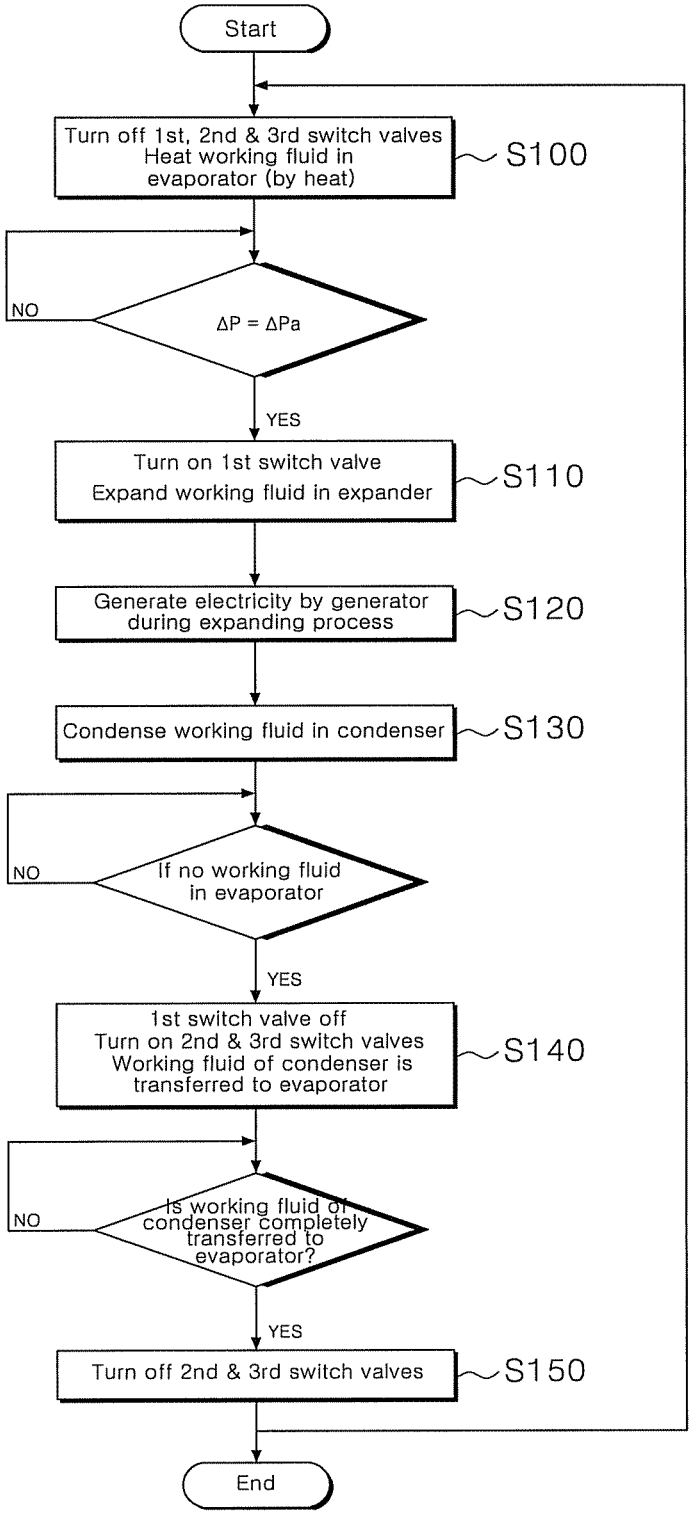
FIG. 5 is a flow chart illustrating a method of controlling the Rankine cycle system according to the first embodiment.

Below, there is provided a detailed description of a method of controlling the Rankine cycle system according to each of the above embodiments:

FIG. 5 is a flow chart illustrating a method of controlling the Rankine cycle system according to the first embodiment. According to the method of controlling the Ranking cycle system illustrated in FIGS. 2 and 5, when the evaporator 10 is filled with the working fluid, the first, second and third switch valves 80, 81 and 82 are closed. When heat is applied to the evaporator 10, the working fluid in the evaporator 10 is evaporated to be converted into a high temperature and high pressure state (S100).

When a pressure difference $\Delta P$ between the pressure before the expander 20 and the pressure after the expander 20 reaches a preset pressure difference $\Delta Pa$, the first switch valve 80 is opened so that the high-temperature and high-pressure working fluid in the evaporator 10 flows into the expander 20 and thus expands in the expander 20 to be converted into a low pressure state (S110). Then, electricity is generated by a generator 30 connected to the expander 20 (S120). Since the process of generating electricity by the generator 30 while the working fluid expands is generally well-known, no further description thereof will be presented.

Subsequently, the working fluid expanded in the expander 20 is transferred to the condenser 40. In the condenser 40, the working fluid is heat-exchanged with cooling water provided from the outside and therefore, the working fluid is condensed in a low temperature and low pressure state (S130).

When no working fluid is present in the evaporator 10 after it is transferred to the condenser 40, the first switch valve 80 is closed and the second and third switch valves 81 and 82 are opened simultaneously. Therefore, the pressure of the evaporator 10 is equal to the pressure of the condenser 40, and the low-temperature and low-pressure working fluid in the condenser 40 is transferred to the evaporator 10 by gravity (S140). When the working fluid of the condenser 40 is completely transferred to the evaporator 10, the second and third switch valves 81 and 82 are closed (S150).

The above-described whole processes are repeatedly performed, to generate electricity.

Figure 6:
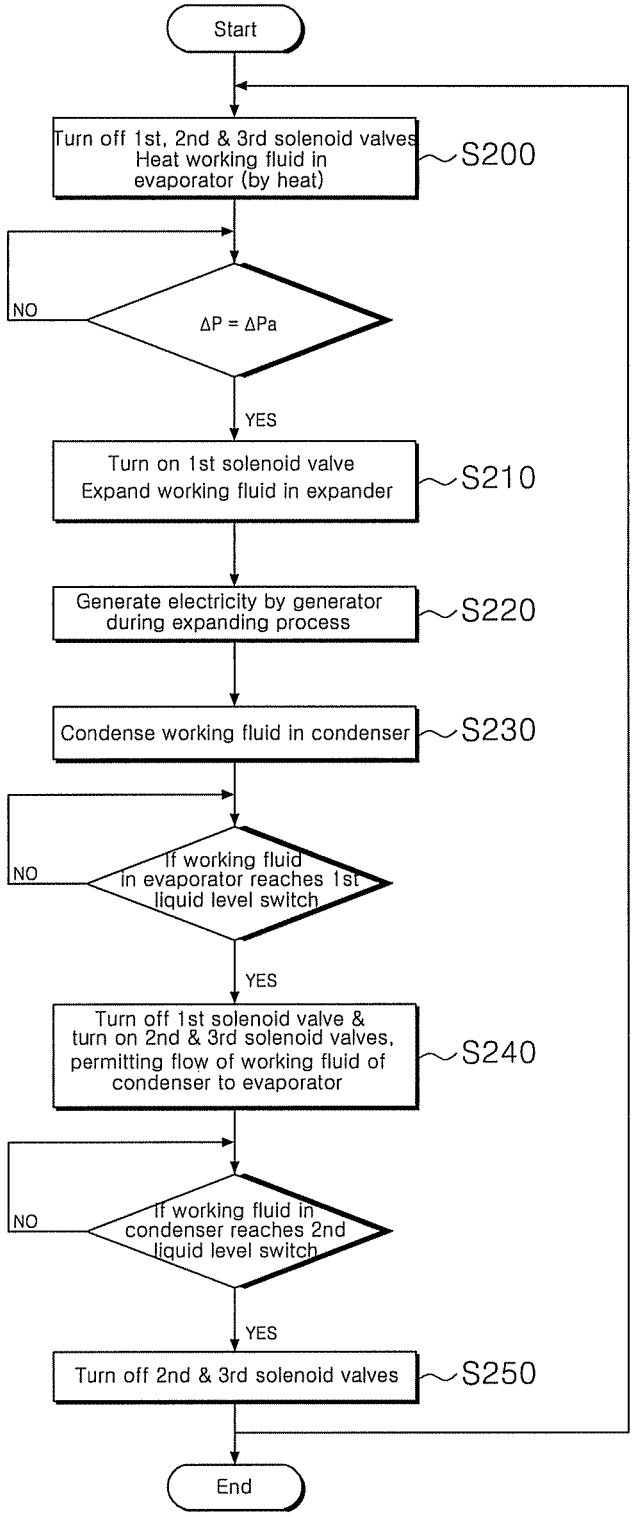
FIG. 6 is a flow chart illustrating a method of controlling the Rankine cycle system according to the second embodiment.

FIG. 6 is a flow chart illustrating a method of controlling the Rankine cycle system according to the second embodiment. According to the method of controlling the Ranking cycle system illustrated in FIGS. 3 and 6, since the pressure of the evaporator 10 is equal to the pressure of the condenser 40 before heat is supplied from a heat source, there is very little pressure difference $\Delta P$ therebetween. Therefore, the first solenoid valve 90 is closed by the first controller 60. Further, since the first and second liquid level switches 93 and 94 are turned on, the second and third solenoid valves 91 and 92 are closed by the second controller 70. That is, at this point, all of the first, second and third solenoid valves 90, 91 and 92 are closed. When heat is applied to the evaporator 10, the working fluid in the evaporator 10 is evaporated to be converted into high temperature and high pressure steam (S200).

When a pressure difference ΔP between the pressure before the expander 20 and the pressure after the expander 20 reaches a preset pressure difference ΔPa of the differential pressure transducer 50, the first solenoid valve 90 is opened by the first controller 60, so that the high-temperature and high-pressure working fluid flows into the expander 20 and expands in the expander 20 to be converted into a low pressure working fluid (S210). Then, electricity is generated by the generator 30 while the working fluid expands in the expander 20 (S220). Since the process of generating electricity by the generator 30 while the working fluid expands is generally well-known, no further description thereof will be presented.

Subsequently, the working fluid expanded in the expander 20 is transferred to the condenser 40. In the condenser 40, the working fluid is heat-exchanged with cooling water provided from the outside and therefore, the working fluid is condensed in a low temperature and low pressure state (S230).

When the liquid level of the working fluid in the evaporator 10 reaches the first liquid level switch 93, the second and third solenoid valves 91 and 92 are opened simultaneously by the second controller 70 receiving a signal from the first liquid level switch 93. Then, the pressure of the evaporator 10 is equal to the pressure of in the condenser 40 and the working fluid in the condenser 40 is transferred to the evaporator 10 by gravity (S240).

Further, when the working fluid of the condenser 40 is transferred to the evaporator 10 and the liquid level in the condenser 40 reaches the second liquid level switch 94, the second and third solenoid valves 91 and 92 are closed by the second controller 70 receiving a signal from the second liquid level switch 94 (S250).

When the pressure of the evaporator 10 is equal to the pressure of the condenser 40 and the pressure difference ΔP is less than the preset pressure difference ΔPa of the differential pressure transducer 50, the first solenoid valve 90 is closed by the first controller 60 receiving a signal from the differential pressure transducer 50.

The above-described whole processes are repeatedly performed, to generate electricity.

As described above, according to the present invention, the Rankine cycle system to generate electricity by using heat as an energy source, and a method of controlling the same does not use a conventional pump for carrying a working fluid. Therefore, the present invention has the effects of reducing the cost of manufacturing the cycle system, saving the power consumed to operate the pump and therefore obtaining a greater output, Furthermore, the Rankine cycle system and the method of controlling the same according to the present invention use the control system to automatically operate the cycle system. Therefore, the present invention has the effect of enabling to stably operate the cycle system even though a heat source is intermittently supplied.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A Rankine cycle system for generating electricity, comprising:

an evaporator filled with a working fluid heated by heat supplied from a heat source and evaporating the working fluid so as to be converted into a high temperature and high pressure gaseous state;

an expander connected to the evaporator and expanding the high-temperature and high-pressure working fluid flowing into the expander;

a generator attached to the expander and generating electricity;

a condenser directly connected to the expander by a pipe through which the expanded working fluid flows into the condenser, condensing the working fluid by heat-exchange with cooling water transferred from the outside so that the working fluid is converted into a low temperature and low pressure liquid state, and transferring the low temperature and low-pressure working fluid to the evaporator;

a first pipe having a first end and a second end, the first end of the first pipe being connected to an outlet of the evaporator;

a first switch valve connected to the second end of the first pipe and permitting/interrupting the working fluid flowing from the evaporator to the expander;

a second pipe having a first end and a second end, the first end of the second pipe being connected to the first switch valve and the second end of the second pipe being connected to an inlet of the expander;

a third pipe having a first end and a second end, the first end of the third pipe being connected to an outlet of the expander and the second end of the third pipe being connected to an inlet of the condenser;

a fourth pipe having a first end and a second end, the first end of the fourth pipe being connected to the condenser;

a second switch valve connected to the second end of the fourth pipe and equalizing a pressure between the condenser and the evaporator;

a fifth pipe having a first end and a second end, the first end of the fifth pipe being connected to the second switch valve and the second end of the fifth pipe being connected to an outlet of the evaporator;

a sixth pipe having a first end and a second end, the first end of the sixth pipe being connected to the condenser;

a third switch valve connected to the second end of the sixth pipe and permitting/interrupting the working fluid flowing from the condenser to the evaporator;

a seventh pipe having a first end and a second end, the first end of the seventh pipe being connected to the third switch valve and the second end of the seventh pipe being connected to the evaporator; and wherein the condenser is installed at a higher position than a position of the evaporator so that the working fluid flows by gravity into the evaporator.

2. The Rankine cycle system of claim 1, wherein the second switch valve further permits/interrupts the working fluid flowing from the condenser to the evaporator.

3. The Rankine cycle system of claim 1, wherein the third switch valve further equalizes the pressure between the condenser and the evaporator.

4. The Rankine cycle system of claim 1, wherein the first switch valve is closed while the working fluid is being transferred from the condenser to the evaporator through the second switch valve and the third switch valve.

5. A Rankine cycle system for generating electricity, comprising:

an evaporator filled with a working fluid heated by heat supplied from a heat source and evaporating the working fluid so as to be converted into a high temperature and high pressure gaseous state;

an expander connected to the evaporator and expanding the high-temperature and high-pressure working fluid flowing into the expander;

a generator attached to the expander and generating electricity;

a condenser directly connected to the expander by a pipe through which the expanded working fluid flows into the condenser, condensing the working fluid by heat-exchange with cooling water transferred from the outside so that the working fluid is converted into a low temperature and low pressure liquid state, and transferring the low temperature and low-pressure working fluid to the evaporator, a differential pressure transducer measuring a pressure difference between a pressure at an outlet of the evaporator and a pressure at an outlet of the expander;

a first pipe having a first end and a second end, the first end of the first pipe being connected to an outlet of the evaporator;

a first solenoid valve connected to the second end of the first pipe and permitting/interrupting the working fluid flowing there through from the evaporator to the expander;

a second pipe having a first end and a second end, the first end of the second pipe being connected to the first solenoid valve and the second end of the second pipe being connected to an inlet of the expander;

a third pipe having a first end and a second end, the first end of the third pipe being connected to an outlet of the expander and the second end of the third pipe being connected to an inlet of the condenser;

a fourth pipe having a first end and a second end, the first end of the fourth pipe being connected to the condenser;

a second solenoid valve connected to the second end of the fourth pipe and equalizing a pressure between the condenser and the evaporator;

a fifth pipe having a first end and a second end, the first end of the fifth pipe being connected to the second solenoid valve and the second end of the fifth pipe being connected to an outlet of the evaporator;

a sixth pipe having a first end and a second end, the first end of the sixth pipe being connected to the condenser;

a third solenoid valve installed at connected to the second end of the sixth pipe and permitting/interrupting the working fluid flowing from the condenser to the evaporator;

a seventh pipe having a first end and a second end, the first end of the seventh pipe being connected to the third solenoid valve and the second end of the seventh pipe being connected to the evaporator;

a first controller receiving the pressure difference from the differential pressure transducer and comparing the pressure difference with a preset pressure, the first controller opening the first solenoid valve when the pressure difference is greater than the preset pressure and closing the first solenoid valve when the pressure difference is not greater than the preset pressure;

a first liquid level switch installed at a bottom of the inside of the evaporator;

a second liquid level switch installed at a bottom of the inside of the condenser and measuring the level of the working fluid; and a second controller opening/closing the second and third solenoid valves according to signals measured by the first and second liquid level switches, wherein the condenser is installed at a higher position than a position of the evaporator so that the working fluid flows by gravity into the evaporator.

6. The Rankine cycle system of claim 5, wherein the third solenoid valve is replaced with a check valve permitting the working fluid to flow from the condenser to the evaporator only.

7. The Rankine cycle system of claim 5, wherein the second solenoid valve further permits/interrupts the working fluid flowing from the condenser to the evaporator.

8. The Rankine cycle system of claim 5, wherein the third solenoid valve further equalizes the pressure between the condenser and the evaporator.

* * * * *